United States Patent [19]

Coxhill

[11] 4,338,732

[45] Jul. 13, 1982

[54] LIFTER CAGE FOR ASPHALT PLANT, DRYERS AND DRUM MIXERS

[75] Inventor: Major Coxhill, Appleton, Wis.

[73] Assignee: Allis-Chalmers Corporation, Milwaukee, Wis.

[21] Appl. No.: 217,534

[22] Filed: Dec. 15, 1980

[51] Int. Cl.[3] ..... F26B 11/04

[52] U.S. Cl. ..... 34/135; 34/136; 366/57; 366/229; 432/118

[58] Field of Search ..... 366/24, 25, 57, 228, 366/229; 34/135, 136, 137, 140, 141, 142; 432/105, 106, 108, 110, 118

[56] References Cited

U.S. PATENT DOCUMENTS

| | | | |
|---|---|---|---|
| 1,057,247 | 3/1913 | Lierfeld | 366/229 |
| 3,717,937 | 2/1973 | Thompson | 34/136 |
| 4,174,181 | 11/1979 | Garbelman et al. | 366/25 |

FOREIGN PATENT DOCUMENTS

| | | | |
|---|---|---|---|
| 362731 | 11/1921 | Fed. Rep. of Germany | 34/142 |
| 626978 | 11/1928 | France | 34/142 |

*Primary Examiner*—Larry I. Schwartz
*Attorney, Agent, or Firm*—Robert C. Jones

[57] ABSTRACT

An asphalt plant apparatus is disclosed having a material lifter cage arranged in coaxial relationship within a mixing drum. The lifter cage includes a plurality of cage lifters having a trough-like configuration for collecting material in the drum and spilling the material in a veil over the cross section of the drum as the cage lifters pass through a rotational path of travel. The cage lifters are divided into two sets alternately arranged about the lifter cage. The two sets consist of a first set of cage lifters having a material retaining surface fixed at an angle with respect to a radial line extending from the axis of rotation and a second set of cage lifters fixed at an angle approximately 20° different from that of the first set. As the cage lifters pass through the path of travel, the first set of lifters spills material over an arc of the path approximately 20° different from the arc over which the second set spills material thereby increasing uniformity of density of material spilling from the lifters over the path of travel.

4 Claims, 8 Drawing Figures

LIFTER CAGE FOR ASPHALT PLANT, DRYERS AND DRUM MIXERS

BACKGROUND

A typical aggregate dryer used in asphalt plants is known as a drum mixer. Such a dryer rotates and contains lifters for showering the aggregate through hot gases given off by combustion of fuel in the burner. A typical drum mixer lifter arrangement includes the longitudinal arrangement of lifters and can be divided into three main types:

(A) Combustion zone lifters, (B) Drying zone lifters, (C) Mixing zone lifters.

The combustion zone lifters are lifters designed to produce a veil-free zone to allow combustion to take place. Drying zone lifters allow for showering and veiling of the aggregate across the cross-sectional area of the drum. As the material falls in a downward trajectory, the hot gases from the burner pass around the material to cause heat transfer between hot gases and the relatively cool material. The last zone is the mixing zone and includes lifters that ensure that the asphalt mixed with the aggregate becomes a homogeneous mix for discharge out of the drum. The asphalt in liquid form is injected generally, just at the beginning of the mixing zone lifters.

Exemplifying prior art apparatus is disclosed in U.S. Pat. No. 2,421,345 wherein drum lifters lift aggregate and permit it to drop across the interior of the drum, but no attention or awareness of the heat transfer problem is considered. U.S. Pat. No. 3,025,611 discloses lifters for lifting the aggregates and dropping them through a hot gas stream. The lifters are provided for adequate draft for the hot gas stream to prevent plugging of the dryer. U.S. Pat. No. 3,641,683 discloses a fixed and adjustable lifter arrangement specifically constructed to ensure an adequate draft for the hot gas stream. U.S. Pat. No. 3,940,120 discloses an arrangement of drum lifters (called buckets) which increases the veiling effect of the falling aggregate to reduce particulate emissions.

The purpose of this disclosure, the interaction of the aggregate and hot gases in the drying zone, will be discussed. It is well known that, in a dryer, the longer the drying zone lifter section is, the more complete the heat transfer is between the exhaust gas and the material being dried.

An infinitely long drum would provide complete heat transfer between the gas and the material. However, in a drum mixer having three zones of lifters, the drying zone, by necessity, is relatively short, thus for efficient operation, a high rate of heat transfer is required in this zone.

FIG. 8 shows a typical cross-section through a drum mixer and illustrates the showering effect obtained in a conventional lifter arrangement. It can be seen that, due to this showering action, the separate pieces of material have a chance to come in direct contact with the hot exhaust gas and heat transfer will take place between the gases and the material.

It can be shown that the showering time for the material in a drum mixer or dryer occupies only 5–10% of the total time that the material is in the dryer. For the balance of the time, the material is in the lifter or in the bed of the material sliding down the sloping drum. While in the latter two positions, the heat transfer will take place at a slower rate due to less material being in direct contact with the gases and only surface material receiving radiant heat.

A recent development in drum mixers has been to use these machines to reprocess reclaimed asphalt paving (RAP) material by mixing it with some virgin material and adding the necessary asphalt cement to make a satisfactory new mix. In such a recycle drum mixer arrangement, where reclaimed asphalt paving (RAP) is fed into a chute positioned over the center of the drum, the chute empties into a shroud surrounding the drum, and the material passes through holes which pierce the periphery of the drum into angled chutes which discharge into the drum towards the discharge end. At the same time, virgin material, such as aggregate, is fed into the feed end of the drum. Asphalt cement is added to the mix slightly downstrean of the RAP material entry point. In the recycle operation, the discharged material is made up of a percentage of RAP material injected into the center of the drum plus a percentage of virgin material fed into the feed end of the drum. These percentage ratios can be 40/60, 50/50, 60/40, 70/30, etc. Because a relatively small amount of virgin material is required in some of these mix ratios, the lifters as shown in FIG. 8 provide only a very thin veil. This allows the flame and exhaust gases to penetrate through the veil without sufficient reduction in the exhaust gas heat. Because the veil of material is relatively thin, the hot gases do not contact enough material to give up their heat, thereby causing excessive heating of the RAP material as it enters the drum. The RAP material is usually material milled off of an old road surface and contains many fines consisting of minus 200 micron particles. These fine particles are swept into the gas stream and if the gas has not been sufficiently cooled in passing through the drying zone, then the excessive heat in the gases will cause smoking of the asphalt material coating the RAP fines. It is also possible to cause the virgin asphalt, as its injection point, to scorch and therefore cause smoke emissions if the gas temperature is too high at the asphalt injection point. This can occur in both recycling and virgin material processes. Smoking of the virgin asphalt cement can be caused by a thin veil in the drying zone, incorrectly positioned asphalt injection point, or a low smoke point asphalt cement.

SUMMARY OF THE INVENTION

The device disclosed herein is termed a lifter cage and operates to increase the efficiency of heat transfer in a relatively short drying zone, thus reducing smoke emissions and fuel usage per ton of mix produced. It is noted when the material leaves the lifters, it falls by gravity the distance between where it leaves the lifters and reaches the bottom of the drum or the surface of the bed moving along the drum. As previously pointed out, this time of falling occupies a relatively short proportion of the time, 5–10% of the total material retention time. It should be noted if the material was instantaneously stopped during its descent the total descent time would increase, the greater the number of times the material is instantaneously stopped, the greater the descent time. For example, if the material was stopped a total of three equal times, the descent time would be 73% longer than the descent time of an unobstructed fall. If the material was stopped nine equal times, the descent time would increase by 200%. If the material was stopped sixteen equal times, the descent time would be 300% more than an unobstructed fall.

It is obvious that in order to arrest the material a total of nine or sixteen times, the drum cross-section would have to be crammed with obstruction devices such as bars, tubes, etc., to such an extent to cause virtually total restriction to the gas flow. Assuming that a reasonable number of instantaneous stoppages or delays to the descent of the material are caused by a mechanical device, that device would only cause a slight obstruction to the exhaust gas flow and would not adversely affect the hot gas flow.

For example, selecting three periods during which the material is accelerated from zero and stopped instantaneously during its fall from the top to the bottom of the drum, the time during which the material is suspended in the gas stream is increased by 73%. This now means that if the material would normally be in suspension for only 10% of the total retention time in the presently known showering section, the use of the present invention will now increase the suspension time to 17.3%. This increased time of suspension in the hot gas stream would obviously give a more efficient overall heat transfer between the gases and material. The percentages of increased material suspension time have also been calculated for various distance combinations of three-zone drops. It can be shown that a three-zone drop combination of 25% of diameter followed by a drop of 50% of diameter, followed by a drop of 25% of diameter, would result in an increase in suspension time of approximately 70%. It would seem from this analysis a reasonable arrester mechanism could be constructed within the parameters of an intial drop of 25% of diameter and 33.3% of diameter.

A device that would reasonably simulate the drop zones is shown in FIGS. 2 and 3. In addition to a large proportion of the material being arrested twice during the fall, there is a significant added benefit of the lifter cage lifters in the bottom position scooping material and lifting it upward through the gas stream and showering it again. It is difficult to calculate exactly the amount of increase in the heat transfer efficiency due to such a device. However, it can be seen that the heat transfer efficiency is substantially increased for the following reasons: (1) the material drop through the drum cross-section will be arrested by the lifter cage in the manner set forth above, thus increasing heat transfer efficiency; (2) the material will be scooped up by the cage lifters and lifted and passed through the gas stream relatively slowly and thus will absorb more heat from the gas stream; (3) being positioned near the burner flame, the cage lifters and material contained in them are subject to a very high rate of radiant heat transfer; (4) the rotational movement of the lifter cage will cause the lifters to discharge between a clock position of nine and three and thus provide for a further showering action for the material to increase veil density and heat transfer from the gases to the material. FIG. 3 discloses a preferred version of an arrangement that will increase the heat transfer efficiency in the manner of methods 1, 2, 3 and 4 above. The illustrated preferred version FIG. 3 presents very little obstruction to the flow of gas. The cage lifters are divided into two sets. Cage lifters of the first set are arranged on the lifter cage at a fixed angle with respect to a radial line extending from the drum's axis of rotation. Cage lifters of the second group are arranged on the lifter cage at a fixed angle differing by approximately 20° from the fixed angle of the first set. Cage lifters of the first and second sets are arranged alternately about the circumference of the lifter cage.

As the lifter cage rotates with the drum, the cage lifters collect material and carry it through a rotational path of travel. The cage lifters spill the material over an arc of the path of travel with the first set spilling material over an arc 20° askew of that over which the second set spills material. Accordingly, the cross sectional area of the drum over which material is falling is increased thereby increasing the uniformity of density of the material veil within the drum.

There are, of course, many, many versions of such devices that could fulfill the purposes described above with various degrees of efficiency. This disclosure is intended to encompass any apparatus or device that increases the time that material is suspended in the gas stream and increase the uniformity of the density of the material veil within the drum without excessive restriction in the gas flow.

The device will, in a conventional drum mixer such as shown in FIG. 1, cause a denser veil and improve heat transfer, thus helping to prevent scorching of injected asphalt cement.

In the case of a recycle drum mixer, the lifter cage will cause a better heat transfer between gases and material and thus reduce heat penetration through to the RAP material entry point.

The device, for the above reasons, will increase heat transfer efficiency in any kiln or dryer using the lifter principle to heat or dry material. The increased heat transfer will provide substantial savings in fuel consumption.

DESCRIPTION OF THE PREFERRED EMBODIMENT OF THE INVENTION

Figure 1:
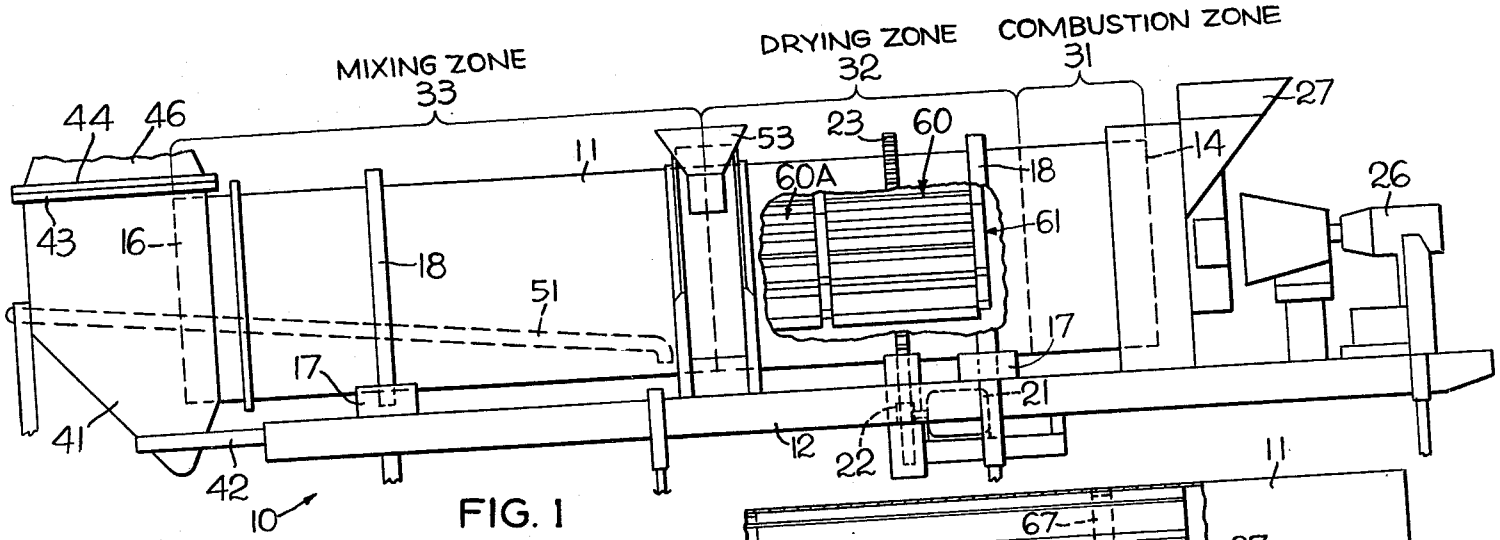
FIG. 1 is a view in side elevation of a mixing apparatus or drum in which the present invention is incorporated with parts broken away to show the lifter cage therein.

Referring to FIG. 1, an asphalt drum or mixer 10 incorporating the features of the present invention is shown. The asphalt drum mixer 10 includes an elongated cylindrical drum 11 that is rotatably mounted on a suitable support 12, herein illustrated as a portable flatbed trailer. The drum 11 rotates about an axis which tilts downwardly from the feed end 14 of the drum to its discharge end 16. Rotational support for the drum 11 is provided by roller set 17 that are carried by the support 12 and are adapted to engage peripheral tracks 18 mounted on the drum in coaxial relationship.

Drum 11 is rotatably driven by a motor 21 through a reducer having on its output shaft a pinion 22 that is in meshing engagement with a ring gear 23 surrounding the drum 11 and attached thereto.

Figure 2:
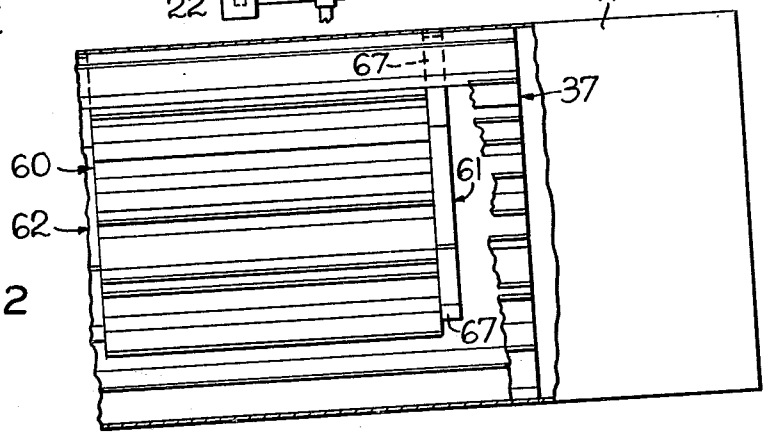
FIG. 2 is an enlarged fragmentary detailed view in elevation of the drying zone, as viewed in FIG. 1, with parts broken away to show the internal arrangement of the lifter cage.
Figure 3:
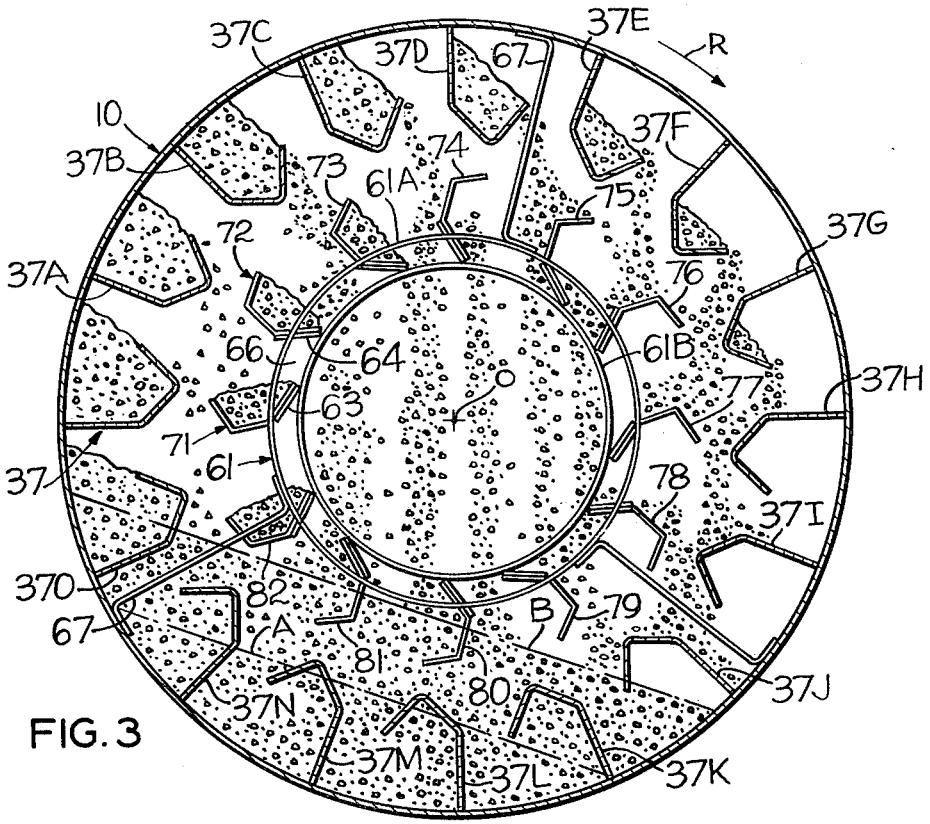
FIG. 3 is a view in cross-section through the drum mixer showing the arrangement of the lifters of the lifter cage within the drum.

At the feed end or the materials inlet end 14 of the drum, a fuel burner 26 is arranged to project a flame a distance into the drum substantially along its axis. Virgin aggregate for an asphalt paving mix is fed into the inlet or feed end 14 of the drum by means of a chute 27. The mixing drum herein shown includes a combustion zone 31, a drying zone 32 and a mixing zone 33. In the interior of the drum there are circumferentially spaced flights of lifters associated with each zone. The drum lifters 37 associated with the drying zone 32 are best illustrated in FIGS. 2 and 3, and extend along the drum wall in spaced-apart longitudinally extending relationship.

Figure 8:
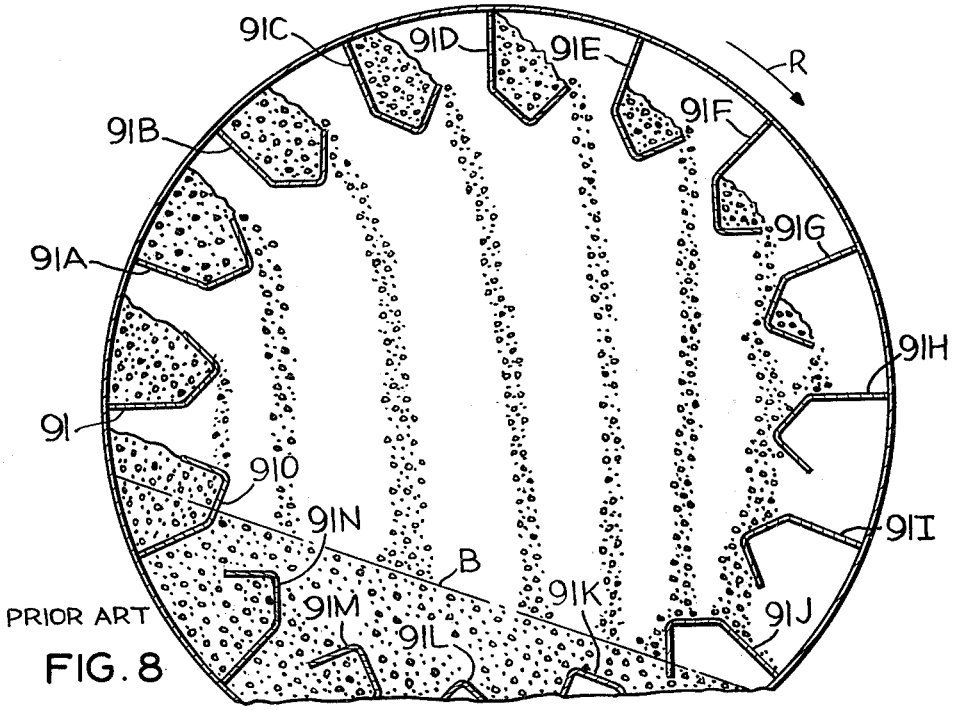
PRIOR ART FIG. 8

The drum lifters 37 in the drying zone 32 provide for showering and veiling of the aggregate across the cross-sectional area of the drum, as depicted in FIG. 8. As the material falls in a downward trajectory, the hot gas from the burner passes through the material veil around the particles to cause heat transfer between the hot gas and the relatively cool material. The lifters in the mixing zone 33 ensure the asphalt injected into the drum is mixed with the aggregate and becomes a homogeneous mix.

The discharge end 16 of the drum extends within a hood or hopper structure 41 supported on spaced-apart horizontally extending frame members 42, only the near side member being visible, which are extensions of the support 12. The uppermost end of the hopper 41 is open and is provided with a flange 43 that is adapted to receive the flanged end 44 of a transitional duct 46 which is connected to a dust collector (not shown).

Liquified asphalt binder is introduced into the drum 11 at a location at the feed end 14 of the mixing zone 33 which is a substantial distance downstream of the flame projected by the burner 26 by means of a delivery pipe 51.

Salvaged asphalt material, when it is being used, is charged into the drum at the start of the mixing zone 33; that is, far enough downstream or ahead of the flame to prevent the asphalt binder content of the salvaged material from being heated to its smoking point but close enough so that it can be sufficiently heated by the virgin material which is preheated in the drying zone and mixed with the virgin material to produce a homogeneous mix at the discharge end 16. The salvaged material is charged into the drum from a hopper 53, through ports or apertures in the wall of the drum 11 that are spaced at regular circumferential intervals around the wall. The hopper 53, which is carried by the support 12, is spaced above the upper portion of the drum and offset on the upside of the drum and is so located that material falls from its bottom outlet directly towards a port which may be beneath it at the time.

When only virgin aggregate material is being processed, the virgin material that is fed into the drum 11 via the chute 27 falls to the bottom of the drum and because of the rotation of the drum 11 will normally assume a bed level "B". If RAP material is being fed into hopper 53, the balance of virgin material fed through chute 27 will form a bed level "A", as indicated in FIG. 3. The drum lifters 37 in the drying zone 32 are similar to the drum lifters in the combustion zone 31 and the mixing zone 33 and thus the description herein will apply to all drum lifters.

The drum lifters 37 are arranged in spaced apart longitudinally extending relationship and are welded or otherwise secured to the inner surface of the drum 11 to extend radially inwardly towards the axis of the drum. In the particular illustration of FIG. 3, the drum lifters 37, present in cross-section, a J-shaped configuration. Thus, with the rotation path of travel of the drum 11 being in a clockwise direction, as viewed in FIG. 3, and indicated by the directional arrow "R" the drum lifters 37 will each pass through the material bed. In passing through the material bed, each flight of lifters scoop up a quantity of the material carrying it upwardly. As each lifter reaches a nine o'clock (9:00) position the position occupied by the lifter 37 in FIG. 3, the material carried by it begins to slide off and cascade downwardly towards the material bed. Thus, as the lifter progresses further along in its path of rotation, each lifter spills a portion of its load until such time as a lifter reaches approximately the two o'clock (2:00) position wherein it will have lost substantially all of the material it was carrying. At this point in the rotational cycle, each lifter will again start its material carrying cycle. Thus, as viewed in FIG. 3, the material as it spills or falls from the rotating lifters provides for a cascading veil of the aggregate material across the cross-sectional area of the drum and the hot gas from the burner passes through this veil of material to cause a heat transfer.

As is known, the longer the drying zone lifter section is, the more complete is the transfer of heat between the exhaust gas and the material being dried. Thus, an infinitely long drum would provide for a complete transfer of heat. However, an infinitely long drum is not practical or possible, and in a drum which incorporates three zones of lifters, the drying zone by necessity, is relatively short. Under this condition, a high rate of heat transfer is not possible. Thus very high temperature gas passes into the mixing zone.

In recycle drum mixers, such as is shown in FIG. 1, reclaimed asphalt paving (RAP) material is fed into the drum via chute 53. At the beginning of the mixing zone 33 and immediately after the drying zone 32, the virgin material moving from the drying zone 32 into the mixing zone mixes with the RAP material that is fed into the drum via chute 53. This mixture of material can have as high as 70% of RAP material with the balance of 30% being virgin material. Because of the relatively small amount of virgin material required, the drum lifters 37 in the drying zone provide for only a relatively thin veil of material through which the hot exhaust gas passes. As a result, a good transfer of heat is not possible, and the hot exhaust gas passes into the mixing zone to act on the high percentage of RAP mixture therein. This causes excessive heating of the RAP material resulting in the smoking of the asphalt material coating the RAP fines. The excessive smoking of the mixture escapes into the atmosphere polluting the environment.

To overcome the problem of the hot exhaust gas entering into the mixing zone 33 and to increase the efficiency of heat transfer in the drying zone 32 and thereby reduce the fuel requirement, there is provided a plurality of lifter cages 60 and 60A which are located in the drying zone 32. The lifter cages 60 and 60A are identical and the description of the lifter cage 60 will also pertain to the lifter cage 60A. As best shown in FIGS. 2 and 3, the lifter cage 60 includes a plurality of spaced-apart circular lifter supports or frame members 61 and 62 which have diameters, in the particular illustration, which are approximately one-half of the diameter of the drum 11. Each of the lifter supports 61 and 62 are identical and are supported from the interior surface of the drum shell 11 in the same manner, thus, a description of the lifter support 61 will also apply to the lifter support 62. As shown in FIG. 3, the lifter support 61 includes a pair of concentrically arranged, spaced-apart rings 61A and 61B. The rings 61A and 61B are maintained in a spaced-apart assembly by means of brackets 63 and 64 which are angularly orientated in the space 66 between the rings and welded to the rings. The circular support or frame member 61 is suspended in coaxial relationship within drum 11 by means of radially extending hangers 67 which are welded to the ring 61A and to the inner wall surface of the drum. The lifter support 62 is supported in a similar manner in the drum. A plurality of lifter cage lifters 71 through 82 are disposed longitudinally across the frame members 61 and 62 and are bolted to the brackets 63 and 64 in spaced-apart relationship, as best shown in FIGS. 4, 5, 6 and 7. The cage lifters 71–82 are formed in a longitudinal length to span the distance between the lifter supports 61 and 62, and present in cross-section, a trough-like configuration having a bottom portion 86 and outwardly inclined sides. Thus, each lifter presents a sloping surface 88 remote from the axis of rotation and a sloping material retaining surface 87 on a side of the cage lifter facing the axis of rotation such as the surfaces 87 and 88 associated with the lifters 71 and 74. The entire assembly forms a lifter cage which rotates with the drum. By providing the lifter cage 60, the time during which the material is suspended in the exhaust gas due to the interruption to its free fall descent, the scooping and lifting action of the cage lifters, the showering from the cage lifters and the radiation from the burner flame into the lifter cage lifters and the material contained in them substantially increases the overall heat transfer efficiency in the drying zone, thus saving fuel. This means that if the material cascading from the drum lifters 37 would normally be in suspension for only 5% of the total retention time in a particular showering section, that time would now be substantially increased. This increased time of suspension in the hot gas stream obviously gives a more efficient overall transfer of heat between the exhaust gas and the material.

A graphic illustration of the cascading veiling of material obtained from the normal or prior art drum mixer is depicted in FIG. 8. As shown therein, the drum lifters 91 at the nine o'clock (9:00) position are spilling only a slight portion of its material load which falls back to the bed creating only a very weak stream of material. As the drum lifters progress in their rotational path of clockwise motion, the lifters spill more and more of their load as depicted by the drum lifters 91A through 91G. As can be seen, as the drum lifters are rotated sufficiently far enough to sequentially occupy the positions in which the lifters 91E, 91F and 91G are shown, the cascading material flow increases at lifter positions between 9 and 12 o'clock and decreases at lifter positions between 12 and 3 o'clock. It is apparent the material returning to the bed as shown in FIG. 8 is in suspension for only a short time as previously stated.

The improved suspension time is best illustrated in FIG. 3 and, as therein depicted, the drum lifter 37 at the nine o'clock (9:00) position is spilling only a slight portion of its material load. This spilling cascades back into the material bed similar to the action of the drum lifter 91 in FIG. 8. However, when the lifter 37 reaches approximately the ten o'clock (10:00) position depicted by the position of lifter 37A, the material cascading therefrom falls into or bounces off the upward moving lifter cage lifter 71 and is moved higher in and discharged from the lifter cage lifter 71 or is delayed by the bouncing action in its descent back to the bed. Thus, the instaneous arresting or deflection or carrying of the falling material by the lifter cage lifter 71 increases the time in which the falling material is in the gas stream. In a similar manner, the drum lifter 37B at the eleven o'clock (11:00) position will spill a portion of its remaining load onto the cage lifters 72 and 73 with some of the material falling back to the material bed. Thus, the cascading material which would normally be in a single cascading stream, as depicted in FIG. 8, is now instantaneously arrested, thus increasing its falling time and thereby increasing its exposure to the hot gases. In addition, as shown in FIG. 3, the stream of material from the drum lifter 37B falling into the cage lifters 72 and 73 is not returned to the material bed at this time but is carried by the cage lifters until the lifters are rotated into the position which the cage lifter 74 occupies. At this point, the material accumulated in the cage lifters spills out in a cascading stream into the hot gas stream. Thus, the material from the drum lifter 37B has now been suspended in the hot gas stream longer than the material from the lifter 91B in FIG. 8. The material from the drum lifter 37C of FIG. 3 is also instanteously arrested by collision with the cage lifter 74. Thus, with the provision of the lifter cage 60, a larger portion of the material is arrested at least twice during its fall. It is therefore apparent that heat transfer efficiency is substantially increased. With the increase in heat transfer efficiency, the danger of smoking of the liquid asphalt coated particles in the mixing zone is minimized. Also, the more efficient heat transfer results in a reduction of fuel usage per ton.

In addition, the rotational movement of the cage lifter 60 effectively passes each cage lifter 71–82, respectively, through the bed of material thereby scooping up a quantity of material from the bed to effectively mix the material and move it up through the gas stream. The material showers out of the lifters between the nine o'clock (9:00) and three o'clock (3:00) positions increasing veiling density. The cage lifters also interrupt the material falling or showering out of the drum lifters 37, thus increasing material fall or descent time. While the cage lifters 71–82 rotate, they and the material contained in them absorb radiant heat from the gas and flame.

As previously mentioned, the lifters 71 through 82 operate to increase the heat transfer efficiency, increasing the time the material is in the hot gas stream. To insure uniformity in the cross-section veiling of the spilling material into the gas stream, the cage lifters, while identical in structure, are angularly arranged alternately so as to provide for a first set of cage lifters or downside showering lifters and a second set of cage lifters or upside showering. The arrangement provides for an even distribution of the showered material across the cross-section of the drum. This is more readily apparent in viewing FIG. 3. As shown, the lifters 71, 73, 75, 77, 79 and 81 are all downside showering lifters. That is, the major portion of the material in these lifters does not start to spill out until the lifter reaches the eleven o'clock (11:00) position. By the time the downside showering lifter reaches the one o'clock (1:00) position, the position occupied by lifter 75, the major portion of its load will be or has been discharged. On the other hand, the upside showering lifters 72, 74, 76, 78, 80 and 82 start spilling the material they are carrying somewhat prior to reaching the ten o'clock (10:00) position and will be completely empty at the twelve o'clock (12:00) position.

Thus, it is apparent the alternate arrangement of downside showering cage lifters and the upside showering cage lifters operate to increase the density of the cross-section veiling of the material being spilt from the drum lifters. In addition, the spilling material from the drum lifters is arrested by the cage lifters so the material is passed through the hot gas stream more slowly, thereby absorbing more heat from the gas stream.

Figure 4:
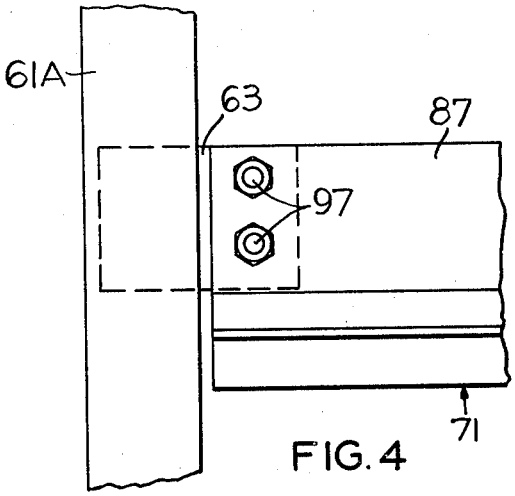
FIGS. 4 and 5 are fragmentary views of replaceable lifter attachment details for downside showering lifters.
Figure 5:
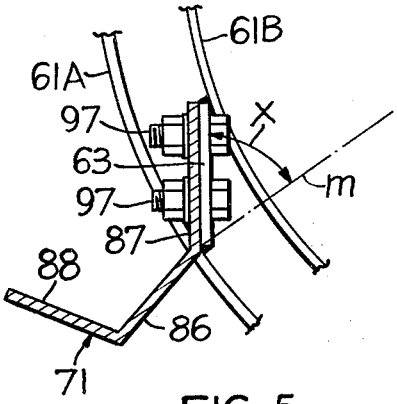

In FIGS. 4 and 5, the arrangement for mounting the downside spilling cage lifter 71 is disclosed and a description thereof will be applied equally to all downside spilling cage lifters. As shown, a bracket 63 a support engaging portion welded between the cage rings 61A and 61B at an angle "x" with respect to a radial line "M" which extends from the drum axis "o" and intersects the corner of the bracket which abuts the inner surface of the outer cage ring 61A. The angle "x", in the particular example herein disclosed, is between 54°–57° which allows for a tolerance variation in the diameter of the rings 61A and 61B. With this arrangement of the bracket 63, the cage lifter 71 is removably secured as with bolts 97 which extend through suitable bolt openings formed in a lifter engaging portion of lifter side 87 and the bracket 63.

Figure 6:
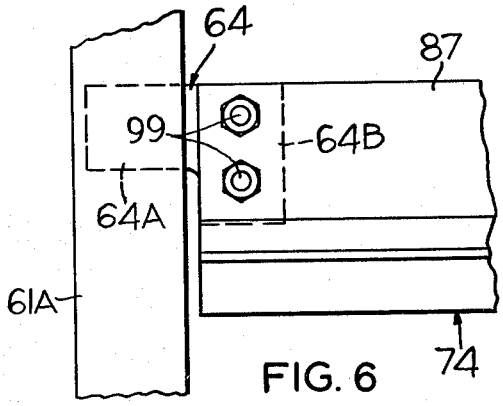
FIGS. 6 and 7 are fragmentary views of replaceable lifter attachment details for upside showering of lifters; and, FIG. 8 is a sectional view through a typical prior art drum mixer showing a typical drum lifter arrangement and the showering effect obtained.
Figure 7:
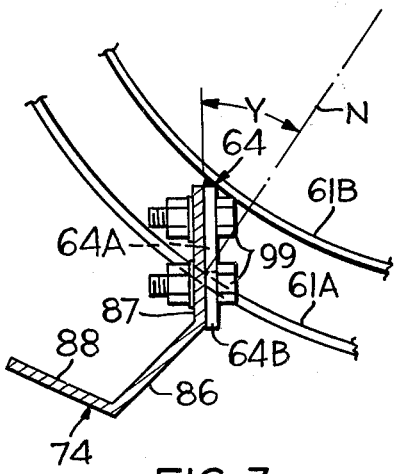

The upside spilling cage lifter 74 is removably secured to its associated bracket 64 by means of bolts 99. The arrangement for mounting the upside spilling cage lifters 72, 74, 76, 78, 80 and 82 is similar to the description pertaining to the lifter 74 and will apply to all upside spilling cage lifters. As shown in FIGS. 6 and 7, the bracket 64 is welded between the cage rings 61A and 61B at an angle "y" with respect to a radial line "n" which extends from the drum axis "o" and intersects the corner of the bracket 64 which abuts the inner surface of the outer cage ring 61A. The angle "y", in the particular example herein disclosed, is between 34°–36° which allows for a tolerance variation in the diameters of the rings 61A and 61B. Since the upside spilling lifter 74 is to discharge fully at approximately the twelve o'clock (12:00) position, its angular orientation is canted downwardly less than that of the downside spilling lifters and is apparent as shown in FIG. 3. To accommodate the bracket 64 and secure it, as by welding, to the rings 61A and 61B, the bracket 64 has a support engaging portion formed as a thumb portion 64A. The thumb portion 64A inserts between the rings 61A and 61B and is welded to the inner surfaces thereof. The inwardly extending lifter engaging portion 64B of the bracket serves as a securing plate for the lifters which is secured thereto by the bolts 99.

The lifter cage herein disclosed presents very little obstruction to the flow of gas while at the same time increasing the total time of the material in the gas stream. There are, of course, other versions of such devices that could fulfill the purposes described above with various degrees of efficiency. This disclosure is intended to encompass any arrangement that increases the time that material is suspended in the gas stream and increase the uniformity of the density of the material veil within the drum without excessive restriction to the gas flow.

The device will, in a conventional drum mixer, such as shown in FIG. 1, cause a denser veil and improve heat transfer, thus preventing scorching of injected asphalt cement.

In the case of a recycle drum mixer, the lifter cage will reduce heat penetration through to the RAP material entry point by increasing the heat transfer efficiency.

The device for the above reasons will increase heat transfer efficiency in any kiln or dryer using the lifter principle to heat, or dry material and provide substantial savings in fuel consumption.

The embodiments of the invention in which an exclusive property or privilege is claimed are defined as follows:

1. An asphalt plant having a rotatable hollow mixing drum provided with an aggregate inlet and asphalt concrete mix outlet, said mixing drum having an axis of rotation inclined downwards from said inlet to said outlet so the aggregate material entering said inlet of said rotating mixing drum forms a moving bed of material and including at least a drying zone through which the material traverses and hot exhaust gas enters, said mixing drum in the drying zone being provided with flights of spaced-apart, longitudinally extending drum lifters affixed to an inner surface of said drum which rotate with said mixing drum to effect a showering and veiling of the aggregate material across the cross section of the mixing drum after said drum lifters have moved through the material bed carrying aggregate material in a rotational path of travel; the improvements comprising:

a lifter cage supported in coaxial relationship within the mixing drum in the drying zone for rotational movement with the mixing drum;

said lifter cage including a plurality of cage lifters disposed longitudinally within said mixing drums;

means for supporting said cage lifters in a spaced cylindrical array coaxial with said mixing drum for rotation therewith;

each of said cage lifters having in cross section a trough-like configuration opening toward said rotational path of travel with said trough-like configuration including a material retaining surface on a side of said cage lifter facing said axis of rotation;

said cage lifters including a plurality of sets including a first set wherein said cage lifters within said first set are supported with material retaining surfaces fixed at a common angle with respect to a radial line extending from said axis of rotation; and said plurality of sets including at least a second set wherein said cage lifters within said second set are supported with material retaining surfaces fixed at a common angle with respect to a radial line extending from said axis of rotatation said common angle of said second set being different from said common angle of said first set; said cage lifters within said plurality of sets are alternately arranged about said spaced cylindrical array;

whereby said cage lifters collect material during rotation with said first set of cage lifters spilling material therein over an arc of said path of travel different from an arc over which said second set of cage lifters spills material therein providing an increased uniformity of material spilling from said cage lifters through said path of travel.

2. An asphalt plant apparatus according to claim 1 wherein said plurality of sets consists of a first set and second set with said common angle of said first set differing from said common angle of said second set by about 20°.

3. An asphalt plant having a rotatable hollow mixing drum provided with an aggregate inlet and asphalt concrete mix outlet, said mixing drum having an axis of rotation inclined downwards from said inlet to said outlet so the aggregate material entering said inlet of said rotating mixing drum forms a moving bed of material and including at least a drying zone through which the material traverses and hot exhaust gas enters, said mixing drum in the drying zone being provided with flights of spaced-apart, longitudinally extending drum lifters affixed to an inner surface of said drum which rotate with said mixing drum to effect a showering and veiling of the aggregate material across the cross section of the mixing drum after said drum lifters have moved through the material bed carrying aggregate material in a rotational path of travel; the improvements comprising:

a lifter cage supported in coaxial relationship within the mixing drum in the drying zone for rotational movement with said mixing drum;

said lifter cage including a plurality of circular lifter supports disposed in spaced relation along said axis of rotation; said lifter supports being perpendicular to and coaxial with said axis of rotation; said lifter supports maintained in spaced relation coaxial with said axis of rotation by a plurality of circumferentially spaced hangers affixed to said lifter supports and extending radially outwardly therefrom and affixed to said inner surface of said drum;

said lifter cage further including a plurality of brackets circumferentially arranged about said lifter supports; each of said brackets including a support engaging portion affixed to said lifter support; each of said brackets further including a lifter engaging portion extending from said support engaging portion with said lifter engaging portion assuming a fixed angle with respect to a radial line extending from said axis of rotation;

said plurality of brackets including a plurality of sets including a first set wherein said fixed angles of said lifter engaging portions of brackets within said first set are identical; said plurality of sets including at least a second set wherein said fixed angle of lifter engaging portions of brackets within said second set are identical and different from said fixed angle of said first set;

said brackets arranged on said lifter supports with brackets within a set being axially aligned with brackets of a similar set on adjacent lifter supports;

said lifter cage further including a plurality of cage lifters extending between axially aligned brackets and affixed to said lifter engaging portion of said brackets; said cage lifters having in cross section a trough-like configuration opening toward said rotational path of travel; said brackets within said plurality of sets are alternately arranged about said lifter supports;

whereby said cage lifters collect material during rotation with said cage lifters affixed to said first set of brackets spilling material therein over an arc of said path of travel different from an arc over which said cage lifters affixed to said second set of brackets spill material therein with said difference in arc represented by said difference between said fixed angles of said first and second set of brackets and thereby providing an increased uniformity of material spilling from said cage lifters through said path of travel.

4. An asphalt plant according to claim 3, wherein said plurality of sets consist of a first set and a second set with said fixed angle of said first set differing from said fixed angle of said second set by about 20°.

* * * * *